US007694481B2

(12) United States Patent
Kestermont

(10) Patent No.: US 7,694,481 B2
(45) Date of Patent: Apr. 13, 2010

(54) GENESIS FOUNDATION WALL SYSTEM

(75) Inventor: Wesley F Kestermont, Ebensburg, PA (US)

(73) Assignee: Laurel Mountain Structures, Inc., Ebensburg, PA (US)

( * ) Notice: Subject to any disclaimer, the term of this patent is extended or adjusted under 35 U.S.C. 154(b) by 697 days.

(21) Appl. No.: 11/220,240

(22) Filed: Sep. 6, 2005

(65) Prior Publication Data

US 2007/0051058 A1 Mar. 8, 2007

(51) Int. Cl.
*E04B 2/70* (2006.01)

(52) U.S. Cl. ..... 52/404.1; 52/407.4; 52/407.3; 52/404.2; 52/293.3; 52/299; 52/236.6

(58) Field of Classification Search ..... 52/404.1, 52/407.3, 407.4, 404.2, 101, 299, 293.1, 52/236.6, 293.3
See application file for complete search history.

(56) References Cited

U.S. PATENT DOCUMENTS

| | | | | | |
|---|---|---|---|---|---|
| 3,492,766 | A * | 2/1970 | Andrews | 52/36.6 |
| 3,657,849 | A * | 4/1972 | Garton | 52/91.1 |
| 4,061,819 | A * | 12/1977 | Barnes | 428/292.4 |
| 4,147,004 | A * | 4/1979 | Day et al. | 52/309.9 |
| 4,628,650 | A * | 12/1986 | Parker | 52/265 |
| 6,290,992 | B1 * | 9/2001 | Magnuson-Hawkins | 424/660 |
| 2004/0182031 | A1 * | 9/2004 | Fay et al. | 52/404.1 |

* cited by examiner

*Primary Examiner*—Phi Dieu Tran A
(74) *Attorney, Agent, or Firm*—The Webb Law Firm

(57) ABSTRACT

An engineered wall system for use above or below ground constituted of zinc-borate treated timber strand studs with sheets of structural fiberglass reinforced plastic and rigid foam insulation. The invention is particularly suitable as an alternative to other materials and methods commonly used to construct foundations for residential structures. This wall system exhibits great strength, durability, as well as improved resistance to mold, insects, water and fire.

1 Claim, 3 Drawing Sheets

STONE FOOTER DESIGN
NOTE TO SCALE

ASSEMBLY OF ENGINEERED PRODUCTS BEFORE ADHESIVE, EPS FOAM AND FIBERGLASS REINFORCED SHEETING IS APPLIED.

NOTE: ALL ENGINEERED PARTS OF THIS PRODUCT TO BONDED TOGETHER WITH SPECIAL WATERPROOF ADHESIVES, MAKING THIS SYSTEM MONOLITHIC ( AS ONE ).

TIMBER STRAND STUD
100% LOAD DURATION

| | |
|---|---|
| MOMENT (FT-LBS) | 2,380 |
| SHEAR (LBS) | 2,200 |
| MOMENT OF INERTIA | (In 4) |
| WEIGHT (LBS. PER LF.) | 3.3 |

STONE FOOTER DESIGN
NOTE TO SCALE

CONCRETE FOOTER DESIGN
NOTE TO SCALE

ASSEMBLY OF ENGINEERED PRODUCTS BEFORE ADHESIVE, EPS FOAM AND FIBERGLASS REINFORCED SHEETING IS APPLIED.

1/4" FLANGE DESIGN
BUTT JOINT CONECTION

1/4" FLANGE DESIGN
CORNER CONECTION

1/4" FLANGE DESIGN
TOP PLATE CAP

GENESIS CONECTORS
FABICATED WITH STRUCTURAL FIBERGLASS
REINFORCED PLASTIC

GENESIS FOUNDATION WALL SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, TABLE, OR A COMPUTER PROGRAM LISTING COMPACT DISK APPENDIX

Not Applicable.

TECHNICAL FIELD

The present invention relates generally to the fields of residential and commercial construction. More specifically, the invention pertains to the construction of structural walls which may be positioned above or below ground level in a wide variety of applications where increased structural strength and improved resistance to fire, insects and moisture is desired.

BACKGROUND OF THE INVENTION

Since the early 1940's technology applied to foundation systems in residential construction have changed little. The predominant method for constructing the foundation has been to pour the concrete footer and the use cinder blocks to build the foundation wall. More recently a "cake mold" method has gained acceptance whereby forms are assembled and concrete is poured into them yielding a solid concrete wall.

The weaknesses associated with the concrete systems are well known within the art and will not be enumerated, however, it is sufficient to state that there has long since been a need for a foundation wall system which can be produced and installed efficiently, with improved insulative characteristics, increased overall strength and long term durability.

The inventor, Wesley F. Kestermont, of Indiana Pa. has devised a wall system which can be place above or below ground using structural fiberglass reinforced plastic as an outside membrane, zinc-borate treated timber strand studs and plates, and joined with rigid foam insulation.

It is an object of the present invention to be of comparatively light weight so that it may be shipped to the job site and assembled in segments.

Is a further object of the present invention to provide greater insulation (system having a higher R value, approximately R=30) than traditional foundations.

It is still a further an object of the present invention to provide a foundation wall with superior ability to withstand both normal forces and shear forces.

It is again another object of the present invention to provide a foundation wall system to provide increased resistance to both water and radon gas in comparison to conventional concrete wall systems.

It is a further object of the invention to provide an integrated wiring chase.

It is still a further object of the invention to be resistant to insects by incorporating treated timber strand studs and foam insulation.

BRIEF SUMMARY OF THE INVENTION

In accordance with the teaching of the present invention all of the problems with the aforementioned prior art arrangements are obviated. The wall system includes framing composed essentially of zinc borate treated timber strand studs, a top and bottom plate, a sheet of fiberglass reinforced plastic affixed with water based adhesives to the outward facing side of the timber frame, foam insulation deposited between the zinc borate treated timber strand studs. This method bonds all engineered products together as forming a single unit.

DETAILED DESCRIPTION OF THE INVENTION

Figure 1:
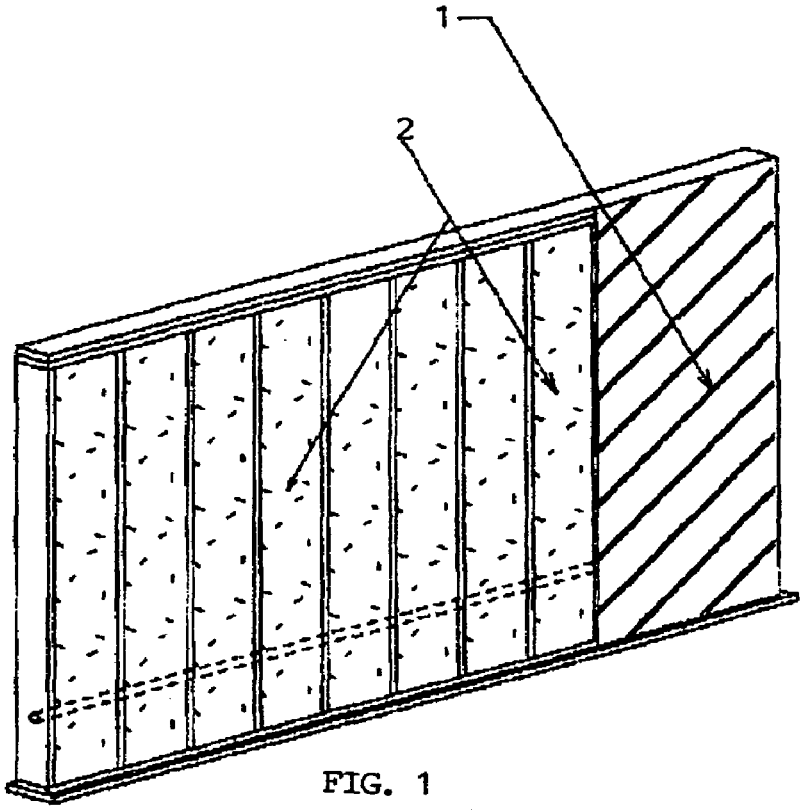
FIG. 1 is a perspective view of the wall system.

The assembly of the invention begins with the construction of a wall by affixing 2×6 zinc-borate treated timber strand studs between a top plate and bottom nailer plate as depicted in FIG. 1. The timber strand studs are commonly used in the construction of buildings designed to withstand extreme weather conditions such as hurricanes. A one and a half inch wiring hole is drilled through each of the studs.

The next step requires that a sheet of structural fiberglass reinforced plastic, cut to fit the wall dimensions, is then affixed to the surface of the studs using waterproof bonding agents. The bonding agents employed must be water based because petroleum based bonding agents would degrade the BPS (expanded polystyrene) foam insulation. The side of the wall donning the fiberglass reinforced plastic will become the outwardly facing surface of the wall system. The stud cavities are then filled with foam insulation. Due to restrictions on hauling large objects, the largest self contained wall which can be transported at the present time to a remote job site is 12' by 40'.

Upon arrival at the desired location the self contained building panels are lag bolted to a 2×12 pressure treated footer plate. Intersecting panels are permanently connected by placing one of the three flange pieces depicted in FIG. 7,8,9. The flange pieces or connectors are also comprised of structural fiberglass reinforced plastic.

BEST MODE FOR CARRYING OUT THE INVENTION

Figure 3:
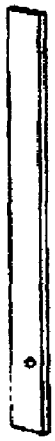
FIG. 3 depicts a zinc-borate treated timber strand stud with the relevant structural statistics.
Figure 4:
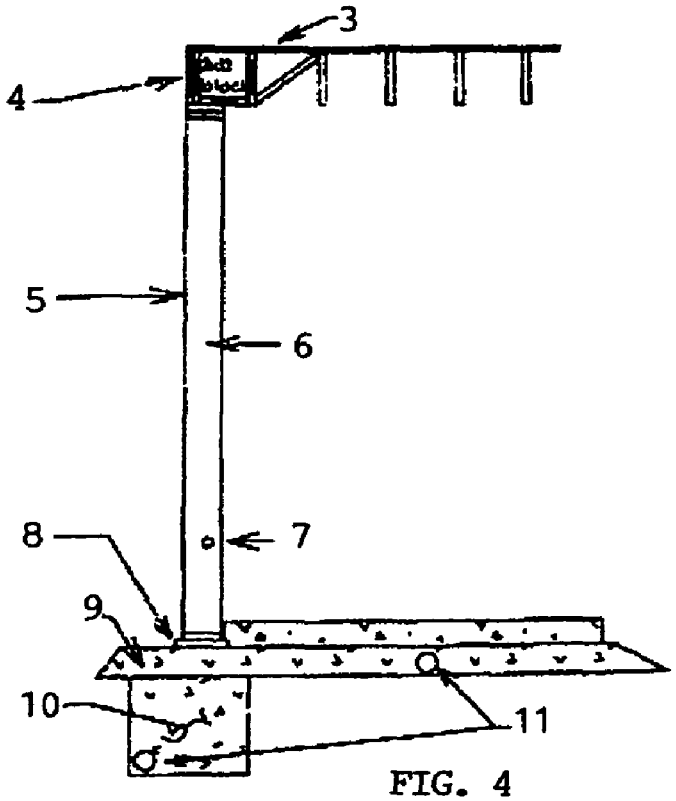
FIG. 4 depicts a wall system positioned on a stone footer.
Figure 5:
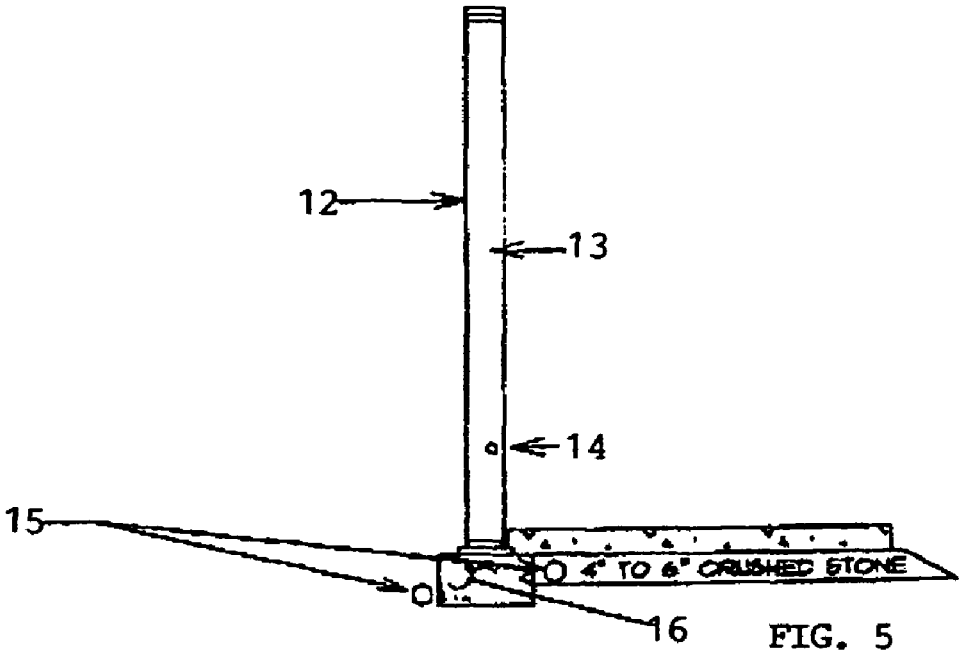
FIG. 5 depicts a wall system positioned on a concrete footer.
Figure 6:
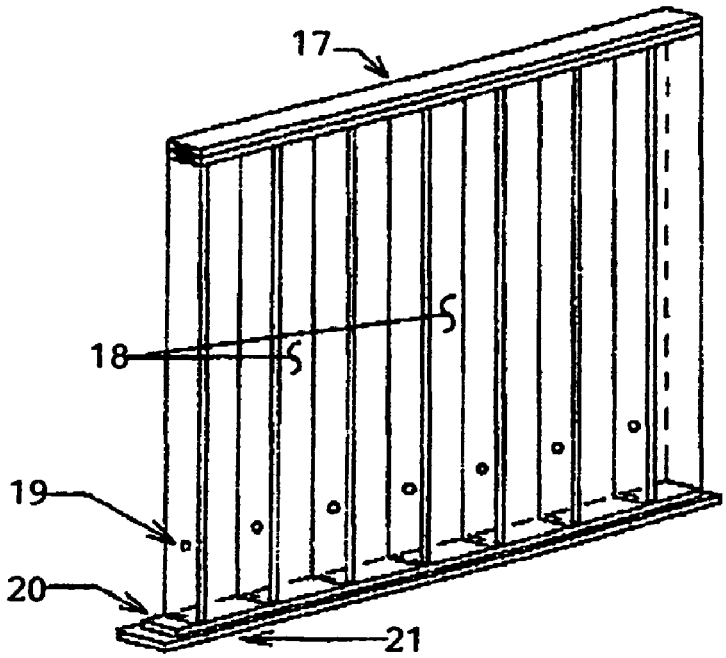
FIG. 6 depicts an assembled wall system.

The preferred method to construct the invention begins with lying a plurality of zinc-borate treated timber strand studs into a jig at precise increments which serve as the perpendicular studs and spraying the timber stand studs with a one part water based adhesive. A typical timber strand stud is shown in FIG. 3 of the drawing sheets. In FIG. 6 at number 19 a timber strand stud is depicted as having a wiring chase. As is known in the art, a timber strand stud is a specific term that refers to engineered lumber having poly strand material of one or more types of wood glued together.

The top and bottom nailer plates, shown in FIG. 6 as number 17 for the top nailer plate and number 20 for the bottom nailer plate, are then affixed to the timber strand studs with stainless steel metal fasteners. It is desirable to attach a second top nailer plate to the top side of the wall later in the process. Styrofoam panels, represented by number 2 in FIG. 1, are then inserted between each timber stand stud cavity. Walls constructed in this fashion may accommodate door and window openings at a variety of positions without compromising the overall strength of the wall.

Figure 2:
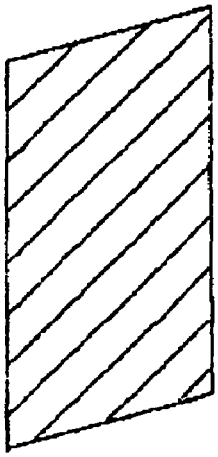
FIG. 2 depicts a single sheet of the fiberglass reinforced plastic material

The $3/16^{th}$ sheets of reinforced plastic panels, one of which is represented by FIG. 2, are then affixed to the outer facing surface of the timber strand studs, again using a spray of one part water based adhesive.

Finally, a second top plate is attached and the system is allowed to set. The finished product is a wall which can endure a crush limit of approximately 5,800 lbs/sq. inch.

Figure 7:
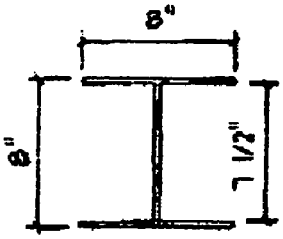
FIG. 7 depicts a butt joint connection in a flange design.
Figure 8:
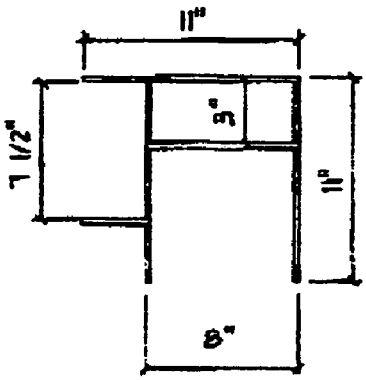
FIG. 8 depicts a flange design corner connection.
Figure 9:
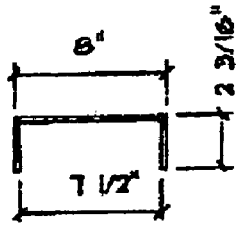
FIG. 9 depicts a flange design top plate cap.

FIG. 7 depicts a butt joint connection in a flange design which is composed of structural fiberglass reinforced plastic and used to connect two sections of wall. FIG. 8 depicts a corner connection having a flange design which is composed of structural fiberglass reinforced plastic used to join two sections of wall in a perpendicular orientation. FIG. 9 depicts a top plate cap composed of structural fiberglass reinforced plastic which would cover any points where sections of wall intersect.

EXAMPLE

An eight by sixteen foot wall was constructed in accordance with the teaching of the best mode. One end of the wall rested on a concrete floor while the second end was raised sixteen inches using blocks. A six ton machine having four tires was then positioned on the wall system. No adverse consequences to the wall system were observed by the inventor. The wall did not exhibit any substantial give in its support elements.

I claim:

1. A foundation wall system for use at least partially underground, the foundation wall system comprising:

(a) a first wall member comprising:

(i) a plurality of timber strand studs having a first end and a second end, wherein each of the plurality of timber strand studs have a 2"×6" depth/width measurement, wherein each timber strand stud is engineered lumber having poly strand material of one or more types of wood glued together and treated with zinc borate;

(ii) a top nailer plate attached to the first end of the plurality of timber strand studs with stainless steel metal fasteners and a bottom nailer plate attached to the second end of the plurality of timber strand studs creating a framework defining stud cavities between the top nailer plate and the bottom nailer plate;

(iii) a rigid foam insulation positioned in the cavity defined by the top nailer plate and the bottom nailer plate, wherein the rigid foam insulation has an R value of substantially 30, wherein the rigid foam insulation is expanded polystyrene;

(iv) a structural fiberglass reinforced plastic sheet ¼" thick containing fiberglass therein, wherein the structural fiberglass reinforced plastic sheet is affixed to one side of the framework of timber strand studs and top nailer plate and bottom nailer plate, wherein the structural fiberglass reinforced plastic sheet is affixed to the framework using a one part water based adhesive, wherein the rigid foam insulation is separate and unattached from the structural fiberglass reinforced plastic sheet, wherein the respective areas along opposing ends of the structural fiberglass reinforced plastic sheet and top and bottom nailer plates form a waterproof bond therealong;

(v) a wiring chase defined in each timber strand stud; and (vi) an opening defined through the rigid foam insulation and the structural fiberglass reinforced plastic sheet, wherein the opening is sized to receive a door or window therein;

(b) a second wall member comprising:

(i) a plurality of timber strand studs having a first end and a second end, wherein each of the plurality of timber strand studs have a 2"×6" depth/width measurement, wherein each timber strand stud is engineered lumber having poly strand material of one or more types of wood glued together and treated with zinc borate;

(ii) a top nailer plate attached to the first end of the plurality of timber strand studs with stainless steel metal fasteners and a bottom nailer plate attached to the second end of the plurality of timber strand studs creating a framework defining stud cavities between the top nailer plate and the bottom nailer plate;

(iii) a rigid foam insulation positioned in the cavity defined by the top nailer plate and the bottom nailer plate, wherein the rigid foam insulation has an R value of substantially 30, wherein the rigid foam insulation is expanded polystyrene;

(iv) a structural fiberglass reinforced plastic sheet ¼" thick containing fiberglass therein, wherein the structural fiberglass reinforced plastic sheet is affixed to one side of the framework of timber strand studs and top nailer plate and bottom nailer plate, wherein the structural fiberglass reinforced plastic sheet is affixed to the framework using a one part water based adhesive, wherein the rigid foam insulation is separate and unattached from the structural fiberglass reinforced plastic sheet, wherein the respective areas along opposing ends of the structural fiberglass reinforced plastic sheet and top and bottom nailer plates form a waterproof bond therealong;

(v) a wiring chase defined in each timber strand stud; and (vi) an opening defined through the rigid foam insulation and the structural fiberglass reinforced plastic sheet, wherein the opening is sized to receive a door or window therein; and (c) a third wall member comprising:

(i) a plurality of timber strand studs having a first end and a second end, wherein each of the plurality of timber strand studs have a 2"×6" depth/width measurement, wherein each timber strand stud is engineered lumber having poly strand material of one or more types of wood glued together and treated with zinc borate;

(ii) a top nailer plate attached to the first end of the plurality of timber strand studs with stainless steel metal fasteners and a bottom nailer plate attached to the second end of the plurality of timber strand studs creating a framework defining stud cavities between the top nailer plate and the bottom nailer plate;

(iii) a rigid foam insulation positioned in the cavity defined by the top nailer plate and the bottom nailer plate, wherein the rigid foam insulation has an R value of substantially 30, wherein the rigid foam insulation is expanded polystyrene;

(iv) a structural fiberglass reinforced plastic sheet ¼" thick containing fiberglass therein, wherein the structural fiberglass reinforced plastic sheet is affixed to one side of the framework of timber strand studs and top nailer plate and bottom nailer plate, wherein the structural fiberglass reinforced plastic sheet is affixed to the framework using a one part water based adhesive, wherein the rigid foam insulation is separate and unattached from the structural fiberglass reinforced plastic sheet, wherein the respective areas along opposing ends of the structural fiberglass reinforced plastic sheet and top and bottom nailer plates form a waterproof bond therealong;

(v) a wiring chase defined in each timber strand stud; and (vi) an opening defined through the rigid foam insulation and the structural fiberglass reinforced plastic sheet, wherein the opening is sized to receive a door or window therein;

(d) a first flange having an I-shaped design for receiving a first end of the first wall member and a first end of the second wall member on opposing sides of a planar section of the first flange such that the first wall member and second wall member are in substantially planar relationship to each other and each abut the planar section, wherein the first flange is constructed of fiberglass reinforced plastic;

(e) a second flange for receiving a second end of the second wall member and a first end of the third wall member such that the second wall member and the third wall member are in substantially perpendicular relationship to each other and partially abut at least a same planar portion of the second flange, wherein the second flange is constructed of fiberglass reinforced plastic; and (f) a stone footer having a drainage channel defined therein and a footer plate substantially corresponding to the shape of the connected first, second, and third wall members, wherein the first wall member, the second wall member, and the third wall member are bolted to the footer plate with a plurality of lag bolts.

* * * * *

UNITED STATES PATENT AND TRADEMARK OFFICE

CERTIFICATE OF CORRECTION

PATENT NO. : 7,694,481 B2
APPLICATION NO. : 11/220240
DATED : April 13, 2010
INVENTOR(S) : Kestermont It is certified that error appears in the above-identified patent and that said Letters Patent is hereby corrected as shown below:

Column 2, Line 43, "BPS" should read -- EPS --

Signed and Sealed this

Tenth Day of August, 2010

David J. Kappos

David J. Kappos
*Director of the United States Patent and Trademark Office*